US008487555B2

(12) United States Patent
Kumar et al.

(10) Patent No.: US 8,487,555 B2
(45) Date of Patent: Jul. 16, 2013

(54) BI-LEVEL LAMP BALLAST

(75) Inventors: Nitin Kumar, Burlington, MA (US); Shashank Bakre, Woburn, MA (US)

(73) Assignee: Osram Sylvania Inc., Danvers, MA (US)

( * ) Notice: Subject to any disclaimer, the term of this patent is extended or adjusted under 35 U.S.C. 154(b) by 321 days.

(21) Appl. No.: 13/105,095

(22) Filed: May 11, 2011

(65) Prior Publication Data

US 2012/0286682 A1 Nov. 15, 2012

(51) Int. Cl.
*H05B 37/02* (2006.01)

(52) U.S. Cl.
USPC ..... 315/312; 315/201; 315/294; 315/205

(58) Field of Classification Search
USPC ..... 315/312, 88, 90, 201, 210, 205, 294, 315/247
See application file for complete search history.

(56) References Cited

U.S. PATENT DOCUMENTS

| | | | | |
|---|---|---|---|---|
| 5,633,540 | A * | 5/1997 | Moan | 307/126 |
| 2005/0012467 | A1 * | 1/2005 | Nemirow et al. | 315/247 |
| 2010/0237791 | A1 * | 9/2010 | Busse et al. | 315/210 |

* cited by examiner

*Primary Examiner* — Daniel D Chang
(74) *Attorney, Agent, or Firm* — Shaun P. Montana

(57) ABSTRACT

A bi-level lamp ballast to selectively operate two lamps is provided. The ballast includes a control circuit having an input, connected to a switching network, and an output, which provides a particular control signal based on the state of the switching network. The ballast also includes respective lamp control switches, each having respective outputs. The first switch is connected to the output and a ballast power supply. In its first state, it connects the ballast power supply to its first output, and in its second state, it connects the ballast power supply to its second output. The second switch is connected to the output and a ground. In its first state, it connects the ground to its first output, and in its second state, it connects the ground to its second output. The state of each lamp control switch depends on the control signal generated by the control circuit.

20 Claims, 3 Drawing Sheets

BI-LEVEL LAMP BALLAST

TECHNICAL FIELD

The present invention relates to lighting, and more specifically, to lamp ballasts.

BACKGROUND

Multiple level lighting systems, such as two level lighting systems, are used in various different lighting applications. For example, two level lighting systems are commonly used in overhead lighting. Such lighting systems conserve energy, because they allow for less light output when full light output is not necessary. A conventional two level lighting system includes two power switches and two ballasts, where each power switch controls only one of the ballasts. Turning on both switches at the same time powers both ballasts, thus producing full light output. Turning on only one of the switches applies power to only one of the ballasts, and thus results in a reduced light output and a corresponding reduction in power consumed.

SUMMARY

Conventional two level lighting systems, such as those described above, are inefficient and costly due to the presence of two ballasts in the system. It is more economical to have a single ballast in the lighting system rather than two ballasts. In a typical implementation of a two level lighting system with only a single ballast, the ballast includes two controllers, each of which controls a respective lamp set. In order to shut off one lamp set, the supply voltage to the controller corresponding to that one lamp set is pulled down (e.g., grounded) so that the controller is disabled. However, this implementation is not energy efficient. Even though a controller is disabled, the supply voltage for that controller is still being pulled from the power supply.

Embodiments of the invention provide a multiple level lighting system using a single ballast, which is more efficient and economical over the prior art. The ballast is configured to connect to a first lamp and a second lamp, and to selectively energize either the first lamp or the second lamp, or both. In particular, the ballast includes a switching network that operates between a first and a second state to selectively connect the ballast to a power supply. A control circuit is connected to the switching network, and is configured to provide a first control signal when the switching network is operating in the first state and to provide a second control signal when the switching network is operating in the second state. The ballast includes a first lamp control switch that operates between a first state and a second state to selectively provide power to a first terminal of the first lamp or the second lamp. The ballast includes a second lamp control switch that operates between a first state and a second state to selectively provide a ground path to a second terminal of the first lamp or the second lamp. The first and second lamp control switches are connected to the control circuit, and the control signal controls whether they are operating in the first state or the second state, and thus whether the first lamp is energized or the second lamp is energized.

In one embodiment, the first lamp and the second lamp are designed to provide different lighting levels when they are energized. For example, the first lamp may be designed to generate a first amount of lumens, and the second lamp may be designed to generate a second amount lumens, wherein the first amount of lumens is greater than the second amount of lumens. Alternatively, the second amount of lumens may be greater than the first amount of lumens. Thus, embodiments allow the first and the second lamps to be selectively and alternatively energized in order to provide two different lighting levels from a single ballast. The switching network allows a user to select whether the first lamp 1 or the second lamp is energized, and accordingly, whether the lamp system emits a first lighting level or a second lighting level.

In an embodiment, there is provided a ballast. The ballast includes: a switching network configured to selectively operate in a first state and in a second state; a control circuit having an input terminal connected to the switching network and an output terminal configured to provide a first control signal when the switching network is operating in the first state and to provide a second control signal with the switching network is operating in the second state; a first lamp control switch connected to the output terminal of the control circuit and to a ballast power supply, the first lamp control switch having a first output terminal configured to connect to a first terminal of a first lamp, the first lamp control switch having a second output terminal configured to connect to a first terminal of a second lamp, wherein the first lamp control switch is configured to operate between a first state in which the ballast power supply is in connection with the first output terminal, and a second state in which the ballast power supply is in connection with the second output terminal; and a second lamp control switch connected to the output terminal of the control circuit and to a ground potential, the second lamp control switch having a first output terminal configured to connect to a second terminal of the first lamp, the second lamp control switch having a second output terminal configured to connect to a second terminal of the second lamp, wherein the second lamp control switch is configured to operate between a first state in which the ground potential is connected to the first output terminal and a second state in which the ground potential is connected to the second output terminal; wherein when the control circuit generates the first control signal, the first lamp control switch operates in the first state and the second lamp control switch operates in the first state so that the ballast provides power to the first lamp; and wherein when the control circuit generates the second control signal, the first lamp control switch operates in the second state and the second lamp control switch operates in the second state so that the ballast provides power to the second lamp.

In a related embodiment, the ballast may further include a power input terminal adapted to connect to an alternating current (AC) power supply and receive AC power from the AC power supply, and the switching network may include a single switch connected between the power input terminal and the control circuit. In a further related embodiment, the switching network may operate in the first state when the input switch inhibits conducting power from the power supply to the control circuit via the input switch, and the switching network may operate in the second state when the input switch conducts power from the power supply to the control circuit.

In another related embodiment, the ballast may further include: a first power input terminal adapted to connect to an alternating current (AC) power supply and receive AC power from the power supply; a second power input terminal adapted to connect to the AC power supply and receive AC power from the AC power supply; a neutral input terminal adapted to connect to the AC power supply; and a rectifier connected to convert AC power received from the AC power supply to direct current (DC) power, wherein the rectifier may be connected between the first power, second power, and neutral input terminals and the first lamp control switch.

In a further related embodiment, the switching network may include: a first input switch connected between the first power input terminal and the rectifier, the first input switch having a conductive state wherein the first input switch conducts AC voltage from the AC power supply to the rectifier, and a non-conductive state wherein the first input switch inhibits power conduction from the AC power supply to the rectifier via the first input switch; and a second input switch connected between the second power input terminal and the rectifier, the second input switch having a conductive state wherein the second input switch conducts AC voltage from the AC power supply to the rectifier, and a non-conductive state wherein the second input switch inhibits power conduction from the AC power supply to the rectifier via the second input switch. In a further related embodiment, the switching network may operate in the first state when the first input switch is operating in the conductive state and the second input switch is operating in the conductive state, and the switching network may operate in the second state when one of the first input switch and the second input switch is operating in the conductive state and the other of the first input switch and the second input switch is operating in the non-conductive state.

In another further related embodiment, the ballast may further include: a power factor correction circuit connected to the rectifier to produce a DC voltage output; and an inverter to convert the DC voltage output to AC voltage for providing to the lamps.

In another related embodiment, the ballast may be connected to the first lamp and to the second lamp, wherein the first lamp may generate a first amount of lumens when energized by the ballast and the second lamp may generate a second amount of lumens when energized by the ballast, the first amount of lumens and the second amount of lumens may be different. In yet another related embodiment, the first lamp control switch and the second lamp control switch may be connected together in parallel.

In another embodiment, there is provided a ballast. The ballast includes: a power input terminal adapted to connect to an alternating current (AC) power supply and receive AC power from the AC power supply; a neutral input terminal adapted to connect to the AC power supply; a control circuit to provide, as a function of receiving power from the AC power supply, one of a first control signal to power a first lamp and a second control signal to power a second lamp; an input switch connected between the power input terminal and the control circuit, the input switch having a conductive state in which the input switch conducts power from the AC power supply to the control circuit, the input switch having a non-conductive state in which the input switch inhibits power conduction from the AC power supply to the control circuit via the input switch; a first lamp control switch connected to the control circuit and to a ballast power supply, the first lamp control switch having a first output terminal configured to connect to a first terminal of the first lamp, the first lamp control switch having a second output terminal configured to connect to a first terminal of the second lamp, wherein the first lamp control switch is configured to operate between a first state in which the ballast power supply is in connection with the first output terminal, and a second state in which the ballast power supply is in connection with the second output terminal based on the control signal received from the control circuit; and a second lamp control switch connected to the output terminal of the control circuit and to a ground potential, the second lamp control switch having a first output terminal configured to connect to a second terminal of the first lamp, the second lamp control switch having a second output terminal configured to connect to a second terminal of the second lamp, wherein the second lamp control switch is configured to operate between a first state in which the ground potential is connected to the first output terminal and a second state in which the ground potential is connected to the second output terminal based on the control signal received from the control circuit.

In a related embodiment, the first lamp control switch may operate in the first state when the first lamp control switch receives the first control signal from the control circuit, and the first lamp control switch may operate in the second state when the first lamp control switch receives the second control signal from the control circuit. In another related embodiment, the second lamp control switch may operate in the first state when the second lamp control switch receives the first control signal from the control circuit, and the second lamp control switch may operate in the second state when the second lamp control switch receives the second control signal from the control circuit. In yet another related embodiment, the control circuit may provide the first control signal when the input switch is operating in the non-conductive state, and the control circuit may provide the second control signal when the input switch is operating in the conductive state. In still yet another related embodiment, the ballast may be connected to the first lamp and to the second lamp, wherein the first lamp may generate a first amount of lumens when energized by the ballast and the second lamp may generate a second amount of lumens when energized by the ballast, the first amount of lumens and the second amount of lumens being different. In still yet another related embodiment, the ballast may further include: a rectifier connected to the power input terminal and the neutral input terminal to convert AC power received from the AC power supply to direct current (DC) power; a power factor correction circuit connected to the rectifier to produce a DC voltage output; and an inverter to convert the DC voltage output to AC voltage for providing to the lamps.

In another embodiment, there is provided a ballast. The ballast includes: a first power input terminal adapted to connect to an alternating current (AC) power supply and receive AC power from the AC power supply; a second power input terminal adapted to connect to the AC power supply and receive AC power from the AC power supply; a neutral input terminal adapted to connect to the AC power supply; a rectifier to convert AC power received from the AC power supply to direct current (DC) power; a power factor correction circuit connected to the rectifier to produce a DC voltage output; an inverter to convert the DC voltage output to AC voltage for providing to the lamps; a first input switch connected between the first power input terminal and the rectifier, the first input switch having a conductive state wherein the first input switch conducts AC voltage from the AC power supply to the rectifier, and a non-conductive state wherein the first input switch inhibits power conduction from the AC power supply to the rectifier via the first input switch; a second input switch connected between the second power input terminal and the rectifier, the second input switch having a conductive state wherein the second input switch conducts AC voltage from the AC power supply to the rectifier, and a non-conductive state wherein the second input switch inhibits power conduction from the AC power supply to the rectifier via the second input switch; a control circuit connected to the rectifier to generate a first control signal when the first input switch and the second input switch are operating in the same state, and to generate a second control signal when the first input switch and the second input switch are operating in different states; a first lamp control switch connected to the control circuit and to a ballast power supply, the first lamp control switch having a first output terminal configured to connect to a first terminal of a first lamp, the first lamp control switch having a second output terminal configured to connect to a first terminal of a second lamp, wherein the first lamp control switch is configured to operate between a first state in which the ballast power supply is in connection with the first output terminal, and a second state in which the ballast power supply is in connection with the second output terminal; and a second lamp control switch connected to the output terminal of the control circuit and to a ground potential, the second lamp control switch having a first output terminal configured to connect to a second terminal of the first lamp, the second lamp control switch having a second output terminal configured to connect to a second terminal of the second lamp, wherein the second lamp control switch is configured to operate between a first state in which the ground potential is connected to the first output terminal and a second state in which the ground potential is connected to the second output terminal; wherein when the control circuit generates the first control signal, the first lamp control switch operates in the first state and the second lamp control switch operates in the first state so that the ballast provides power to the first lamp; and wherein when the control circuit generates the second control signal, the first lamp control switch operates in the second state and the second lamp control switch operates in the second state so that the ballast provides power to the second lamp.

In a related embodiment, the control circuit may generate the first control signal when the first input switch and the second input switch are both operating in the conductive state. In another related embodiment, the control circuit may generate the second control signal when one of the first input switch and the second input switch is operating in the conductive state and the other of the first input switch and the second input switch is operating in the non-conductive state. In still another related embodiment, the ballast may be connected to the first lamp and to the second lamp, wherein the first lamp may generate a first amount of lumens when energized by the ballast and the second lamp may generate a second amount of lumens when energized by the ballast, the first amount of lumens and the second amount of lumens being different. In yet another related embodiment, the first lamp control switch and the second lamp control switch may be connected together in parallel.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
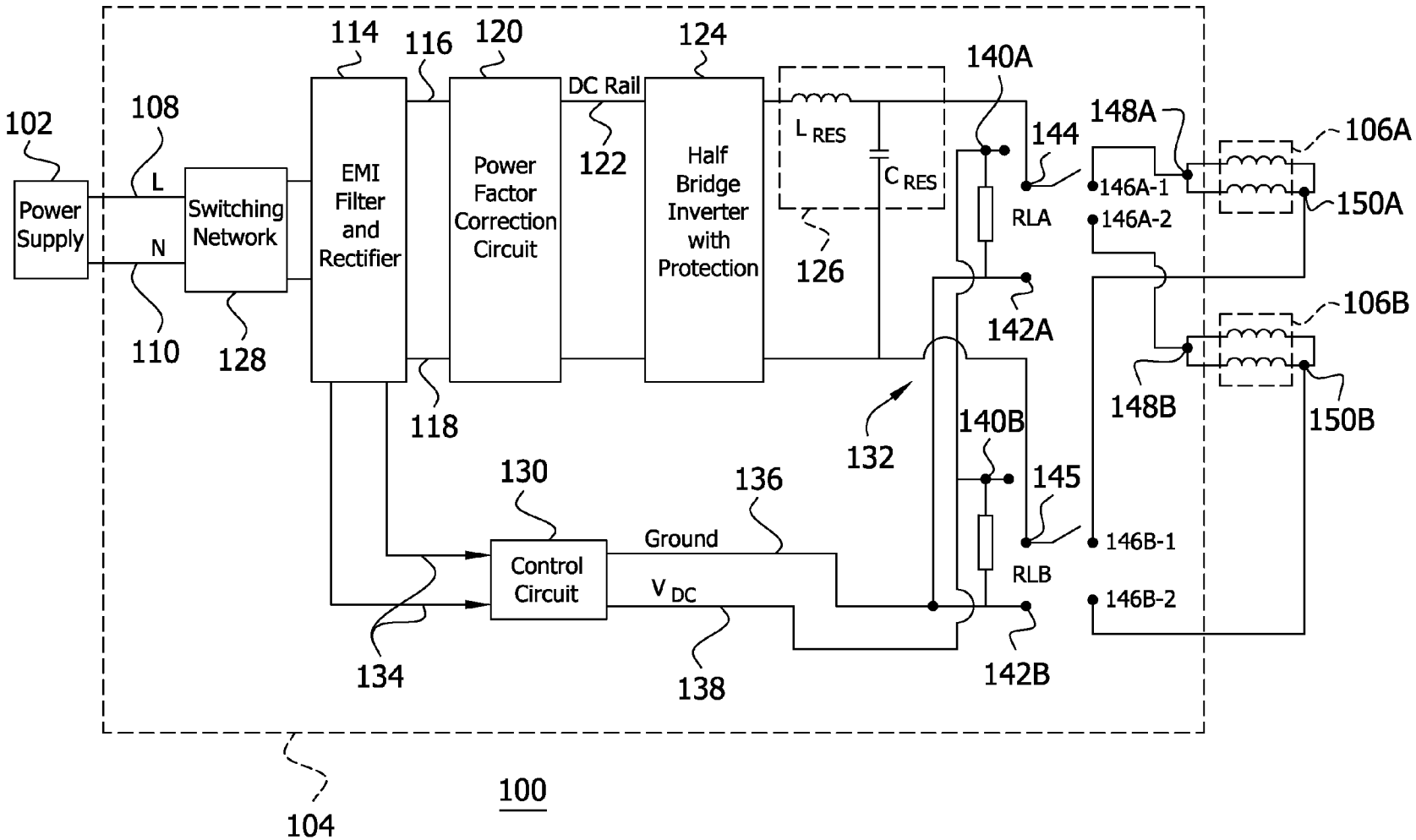
FIG. 1 shows a lamp system including a ballast according to embodiments disclosed herein.

FIG. 1 illustrates a lamp system 100. The lamp system 100 includes an input power source, such as an alternating current (AC) power supply 102, an electronic ballast 104 (hereinafter ballast 104), and a plurality of lamps 106. In particular, the lamp system 100 shown in FIG. 1 includes a first lamp 106A and a second lamp 106B. However, additional lamps may be used without departing from the scope of the invention. In some embodiments, a lamp in the plurality of lamps 106 is an electrodeless lamp, such the ICETRON® lamp available from OSRAM SYLVANIA, the QL induction lamp available from Philips, the GENURA® lamp available from General Electric, and the EVERLIGHT® lamp available from Matsushita. However, the scope of the application contemplates the use of other types of lamps as well.

The ballast 104 includes at least one high voltage input terminal (i.e., line voltage input terminal) 108 adapted for connecting to an alternating current (AC) power supply (e.g., standard 120V AC household power), a neutral input terminal 110, and a ground terminal connectable to ground potential (not illustrated). An input AC power signal is received by the ballast 104 from the AC power supply 102 via the high voltage input terminal 108. The ballast 104 includes an electromagnetic interference (EMI) filter and a rectifier (e.g., full-wave rectifier) 114, which are illustrated together in FIG. 1. The EMI filter portion of the EMI filter and rectifier 114 prevents noise that may be generated by the ballast 104 from being transmitted back to the AC power supply 102. The rectifier portion of the EMI filter and rectifier 114 converts AC voltage received from the AC power supply 102 to DC (direct current) voltage. The rectifier portion includes a first output terminal connected to a DC bus 116 and a second output terminal connected to a ground potential at ground connection point 118. Thus, the EMI filter and rectifier 114 outputs a DC voltage on the DC bus 116.

A power factor correction circuit 120, which may, in some embodiments, be a boost converter, is connected to the first and second output terminals of the EMI filter and rectifier 114. The power factor correction circuit 120 receives the rectified DC voltage and produces a high DC voltage on a high DC voltage bus ("high DC bus") 122. For example, the power factor correction circuit 120 may provide a voltage of around 450 volts to the high DC voltage bus 122. An inverter circuit 124 having an inverter input is connected to the power factor correction circuit 120 for receiving the high DC voltage and converting it to AC voltage.

In some embodiments, the inverter circuit 124 includes a protection circuit. The protection circuit senses the AC voltage signal being provided to the lamps 106A, 106B and shuts down the inverter circuit 124 if the AC voltage exceeds a predefined threshold value. For example, the protection circuit is able to shut down the inverter circuit 124 when there is no lamp connected to the ballast 104 because the lamp is not present, or because wires used to connect one or more of the lamps 106A, 106B to the ballast 104 have become disconnected during normal operation. In some embodiments, the inverter output is connected to the resonant circuit. The resonant circuit comprises an inductor $L_{RES}$ and a capacitor $C_{RES}$ connected together in series. The resonant circuit $L_{RES}$, $C_{RES}$ provides a high voltage for igniting the lamps 106A and 106B, and also provides a magnitude-limited current for operating the lamps 106A and 106B at a particular current.

The ballast 104 also includes an input switching network 128, a control circuit 130, and lamp control switches 132 in order to selectively operate each of the lamps 106A and 106B. The input switching network 128 is connected between the ballast input terminals (e.g., high voltage input terminal 108, neutral terminal 110) and the EMI filter and rectifier 114. As will be described in detail below, the input switching network 128 comprises at least one switch and is configured to selectively operate in a first state and in a second state based on the state (e.g., open/non-conductive/OFF, closed/conductive/

ON) of the at least one switch. The control circuit 130 has an input terminal(s) 134 connected to the input switching network 128. The control circuit 130 has a ground output terminal 136 and a DC voltage ($V_{DC}$) output terminal 138, each connected to the lamp control switches 132. The control circuit 130 receives an input signal that is indicative of the state of the switching network 128 via the input terminal 134. In some embodiments, the control circuit 130 selectively receives power from the AC power supply 102 via the EMI filter 114 as a function of the state of the switching network 128. The control circuit 130 is configured to provide a control signal based on the state of the switching network 128 (i.e., as a function of the input signal received from the power supply 102). In some embodiments, the control circuit 130 generates a first control signal (i.e., control signal having a first value; e.g., 0 Volts) when the switching network 128 is operating in the first state, and the control circuit 130 generates a second control signal (i.e., control signal having a second value; e.g., 5 Volts) when the switching network 128 is operating in the second state. The control circuit 130 provides the control signal (e.g., first control signal or second control signal) to the lamp control switches 132 via the DC voltage output terminal 138.

The control signal controls the operation of the lamp control switches. In FIG. 1, a first lamp control switch RLA (e.g., a JQC-3FF relay available from HONGFA RELAY) is connected to the output terminals (e.g., the $V_{DC}$ output terminal 138 and the ground output terminal 136) of the control circuit 130 at 140A and 142A. The first lamp control switch RLA is also connected to the AC power supply 102 via the resonant circuit 126 at 144. The first lamp control switch RLA has a first output terminal 146A-1 and a second output terminal 146A-2. The first output terminal 146A-1 is configured for connecting to a first terminal 148A of the first lamp 106A, and the second output terminal 146A-2 is configured for connecting to a first terminal 148B of the second lamp 106B. The first lamp control switch RLA is configured to operate between a first state and a second state as a function of the control signal. In some embodiments, when the control circuit 130 provides the first control signal to the first lamp control switch RLA, the first lamp control switch RLA operates in the first state. On the other hand, when the control circuit 130 provides the second control signal to the first lamp control switch RLA, the first lamp control switch RLA operates in the second state. In the first state, the first lamp control switch RLA operates so that the AC power supply 102 is in connection with the first output terminal 146A-1. In the second state, the first lamp control switch RLA operates so that the AC power supply 102 is in connection with the second output terminal 146A-2.

FIG. 1 also shows a second lamp control switch RLB, which is connected in parallel with the first lamp control switch RLA. In particular, the second lamp control switch RLB (e.g., a JQC-3FF relay available from HONGFA RELAY) is connected to the output terminals (e.g., the $V_{DC}$ output terminal 138 and the ground output terminal 136) of the control circuit 130 at 140B and 142B. The second lamp control switch RLB is also connected to ground potential at 145. The second lamp control switch RLB has a first output terminal 146B-1 and a second output terminal 146B-2. The first output terminal 146B-1 is configured for connecting to a second terminal 150A of the first lamp 106A, and the second output terminal 146B-2 is configured for connecting to a second terminal 150B of the second lamp 106B. The second lamp control switch RLB is configured to operate between a first state and a second state as a function of the control signal. In some embodiments, when the control circuit 130 provides the first control signal to the second lamp control switch RLB, the second lamp control switch RLB operates in the first state. On the other hand, when the control circuit 130 provides the second control signal to the second lamp control switch RLB, the second lamp control switch RLB operates in the second state. In the first state, the second lamp control switch RLB operates so that the ground potential is in connection with the first output terminal 146B-1. In the second state, the second lamp control switch RLB operates so that the ground potential is in connection with the second output terminal 146B-2.

Accordingly, when the control circuit 130 generates the first control signal, the first lamp control switch RLA provides power to the first lamp 106A, and the second lamp control switch RLB provides a return path to the first lamp 106A so that the first lamp 106A is energized. Similarly, when the control circuit 130 generates the second control signal, the second lamp control switch RLB provides power to the second lamp 106B, and the second lamp control switch RLB provides a return path to the second lamp 106B so that the second lamp 106B is energized. In some embodiments, the first lamp 106A and the second lamp 106B are designed to provide different lighting levels when they are energized. For example, the first lamp 106A may be designed to generate a first amount of lumens, and the second lamp 106B may be designed to generate a second amount lumens, wherein the first amount of lumens is greater than the second amount of lumens. Alternatively, the second amount of lumens may be greater than the first amount of lumens. The amount of input power needed to operate each of the lamps 106A, 106B may differ as well. For example, the first lamp 106A may be a 100 Watt lamp and the second lamp 106A may be a 40 or 70 Watt lamp. Thus, embodiments allow the first and the second lamps 106A and 106B to be selectively and alternatively energized in order to provide two different lighting levels from a single ballast 104. The switching network 128 allows a user to select whether the first lamp 106A or the second lamp 106B is energized, and accordingly, whether the lamp system 100 emits a first lighting level or a second lighting level.

Figure 2:
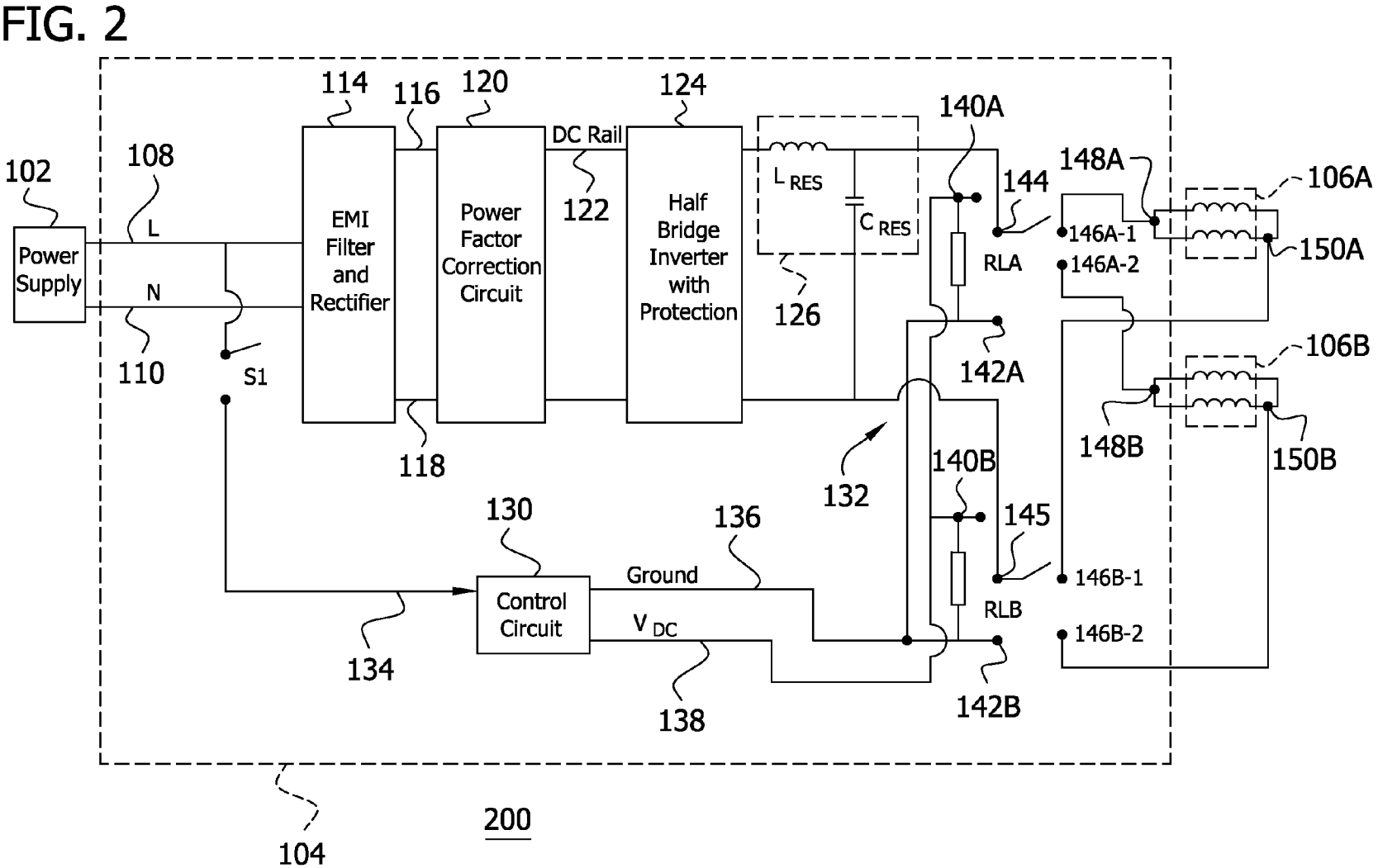
FIG. 2 shows a lamp system including a ballast according to embodiments disclosed herein.

Referring now to a lamp system 200 illustrated in FIG. 2, in some embodiments, the switching network comprises a single switch (input switch S1) that is connected between the AC power supply 102 and the control circuit 130. In particular, the input switch S1 is connected to the high voltage input terminal 108 and to the control circuit 130. The input switch S1 has a conductive state and a non-conductive state. When the input switch S1 is operating in the non-conductive state, the input switch S1 does not conduct power from the AC power supply 102 to the control circuit 130 (e.g., inhibits power conduction from the AC power supply 102 to the control circuit 130 via the input switch S1). As such, the control circuit 130 does not receive power from the AC power supply 102 via the input switch S1, and in the absence of receiving power from the AC power supply 102 via the input switch S1, the control circuit 130 generates a first control signal (e.g., voltage value across the DC voltage terminal $V_{DC}$ 138 and the ground output terminal 136). In some embodiments, in the absence of receiving power from the AC power supply 102 via the input switch S1, the control circuit 130 outputs a control signal across the output terminals (DC voltage terminal $V_{DC}$ 138 and ground output terminal 136) having a value of zero volts. On the other hand, when the input switch S1 is operating in the conductive state, the input switch S1 conducts power from the AC power supply 102 to the control circuit 130. The control circuit 130 receives the power from the AC power supply 102, and responsive thereto, generates a second control signal (e.g., voltage value across the DC voltage terminal $V_{DC}$ 138 and ground output terminal 136). In some embodiments, when the control circuit 130 receives power from the AC power supply 102, the control circuit 130 outputs a control signal across the output terminals (the DC voltage terminal $V_{DC}$ 138 and the ground output terminal 136) having a value of five volts.

As similarly discussed in connection with the lamp system 100, when the first and second lamp control switches RLA and RLB receive the first control signal (e.g., zero volt signal) via the output terminals (i.e., the DC voltage terminal $V_{DC}$ 138 and the ground output terminal 136) of the control circuit 130, the first lamp control switch RLA provides power to the first terminal 148A of the first lamp 106A and the second lamp control switch RLB connects the second terminal 150A of the first lamp 106A to ground. When the first and second lamp control switches RLA and RLB receive the second control signal (e.g., five volt signal) via the output terminals (i.e., the DC voltage terminal $V_{DC}$ 138 and the ground output terminal 136) of the control circuit 130, the first lamp control switch RLA provides power to the first terminal 148B of the second lamp 106B and the second lamp control switch RLB connects the second terminal 150A of the first lamp 106A to ground. Thus, when the input switch S1 is non-conductive, the first lamp control switch RLA and the second lamp control switch RLB provide a power path and ground path, respectively, to the first lamp 106A in order to energize the first lamp 106A. When the input switch S1 is conductive, the first lamp control switch RLA and the second lamp control switch RLB provide a power path and ground path, respectively, to the second lamp 106B in order to energize the second lamp 106B. As such, when the input switch S1 is operated in the non-conductive state, the first lamp 106A is energized generating a first lighting output level. And, when the input switch S1 is operated in the conductive state, the second lamp 106B is energized generating a second lighting output level.

Figure 3:
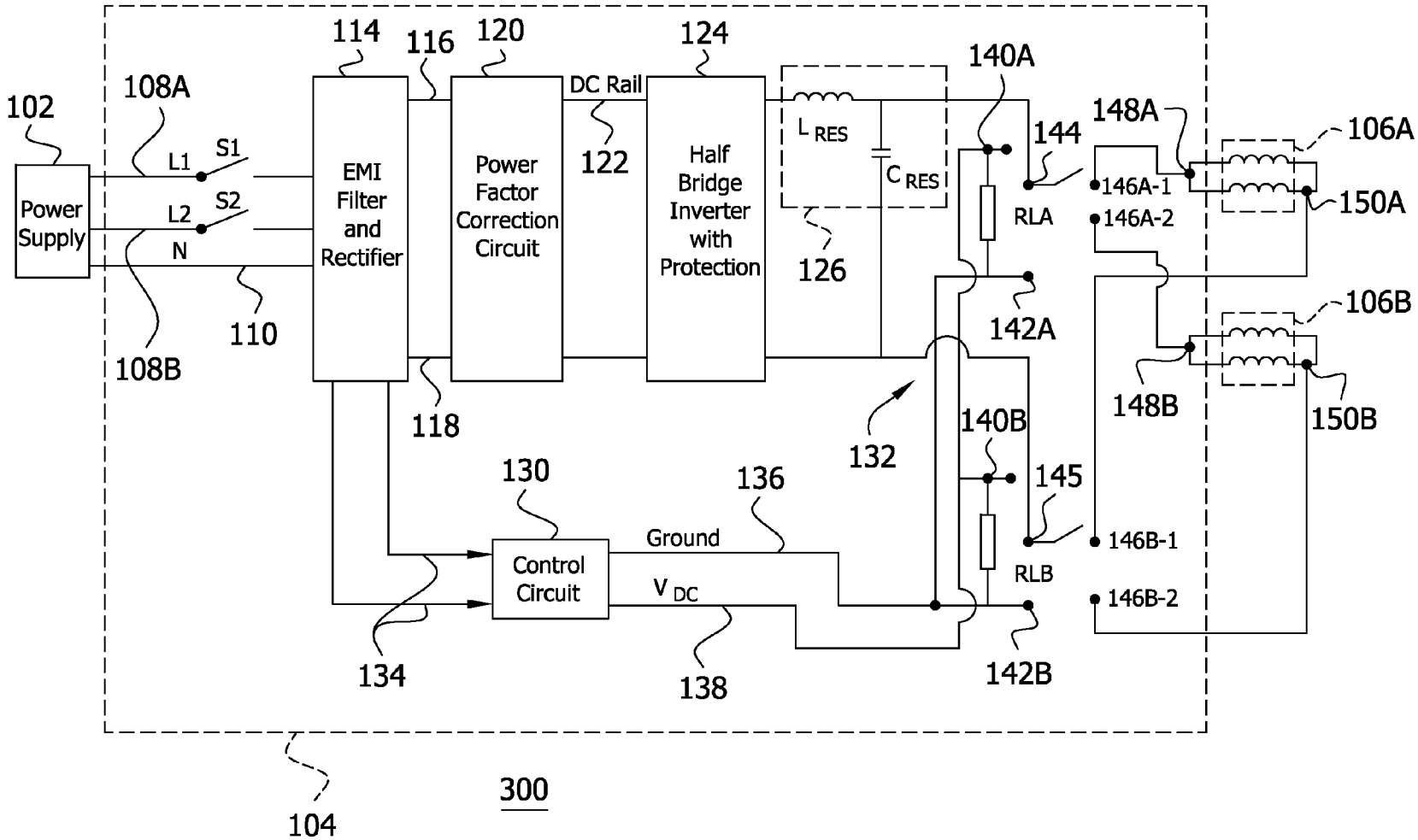
FIG. 3 shows a ballast according to embodiments disclosed herein.

Referring to a lamp system 300 illustrated in FIG. 3, a ballast 104 includes a first high voltage input terminal 108A for connecting the ballast 104 to a first power supply line L1, and a second high voltage input terminal 108B for connecting the ballast 104 to a second power supply line L2. The switching network includes a first input switch S1 for selectively connecting the first power supply line L1 to the ballast 104 via the first high voltage input terminal 108A, and a second input switch S2 for selectively connecting the second power line L2 to the ballast 104 via the second high voltage input terminal 108B. The first input switch S1 is connected between the first high voltage input terminal 108A and the EMI filter and rectifier 114 for selectively connecting the first power supply line L1 to the EMI filter and rectifier 114. The second input switch S2 is connected between the second high voltage input terminal 108B and the EMI filter and rectifier 114 for selectively connecting the second power supply line L2 to the EMI filter and rectifier 114.

Each of the first and second input switches S1 and S2 has a conductive state and a non-conductive state. When the first input switch S1 operates in the conductive state, the first input switch S1 conducts power from the AC power supply 102 to the ballast 104. In particular, during the conductive state, the first input switch S1 conducts power from the AC power supply 102 via the first power supply line L1 to the EMI filter and rectifier 114. When the first input switch S1 operates in the non-conductive state, the first input switch S1 does not conduct power from the AC power supply 102 via the first supply line L1 to the EMI filter and rectifier 114 (e.g., the first input switch S1 inhibits power conduction from the AC power supply 102 to the rectifier via the first input switch S1). When the second input switch S2 operates in the conductive state, the second input switch S2 conducts power from the AC power supply 102 to the ballast 104. In particular, during the conductive state, the second input switch S2 conducts power from the AC power supply 102 via the second power supply line L2 to the EMI filter and rectifier 114. When the second input switch S2 operates in the non-conductive state, the second input switch S2 does not conduct power from the AC power supply 102 via the second supply line L2 to the EMI filter and rectifier 114 (e.g., the second input switch S2 inhibits power conduction from the AC power supply 102 to the rectifier via the second input switch S2).

In the lamp system 300, the control circuit 130 is connected to the EMI filter and rectifier 114, and receives an input signal from the EMI filter and rectifier 114 via input terminals 134. In some embodiments, the control circuit 130 receives a first input signal from the EMI filter and rectifier 114 via input terminals 134 when the first input switch S1 and the second input switch S2 are both operating in conductive states (e.g., S1 and S2 are closed/ON). In response to receiving the first input signal from the EMI filter and rectifier 114, the control circuit generates a first control signal (e.g., control signal having a value of zero Volts) across the output terminals (the DC voltage terminal $V_{DC}$ 138 and the ground output terminal 136). The control circuit 130 receives a second input signal from the EMI filter and rectifier 114 via input terminals 134 when either the first or the second input switch, S1 or S2, is operating in the conductive state, and the other of the input switch S1 or S2 is operating in the non-conductive state (e.g., S1 is closed/ON, and S2 is open/OFF; or S1 is open/OFF and S2 is closed/ON). In other words, the control circuit 130 generates the second control signal when the first and second input switches, S1 and S2, are operating in different states. In response to receiving the second input signal from the EMI filter and rectifier 114, the control circuit 130 generates a second control signal (e.g., control signal having a value of five Volts) across the output terminals (the DC voltage terminal $V_{DC}$ 138 and the ground output terminal 136).

As similarly discussed in connection with the lamp systems 100 and 200, when the first and second lamp control switches RLA and RLB receive the first control signal (e.g., zero volt signal) via the output terminals (the DC voltage terminal $V_{DC}$ 138 and the ground output terminal 136) of the control circuit 130, the first lamp control switch RLA provides power to the first terminal 148A of the first lamp 106A and the second lamp control switch RLB connects the second terminal 150A of the first lamp 106A to ground. When the first and second lamp control switches RLA and RLB receive the second control signal (e.g., five volt signal) via the output terminals (the DC voltage terminal $V_{DC}$ 138 and the ground output terminal 136) of the control circuit 130, the first lamp control switch RLA provides power to the first terminal 148B of the second lamp 106B and the second lamp control switch RLB connects the second terminal 150A of the first lamp 106A to ground.

It should be noted that when both the first and the second input switches S1 and S2 are operating in non-conductive states, no power is conducted from the AC power supply 102 to the ballast 104 so the lamps are not illuminated regardless of the position of the first and second lamp control switches RLA and RLB. Thus, when the first and second input switches S1 and S2 are both conductive (broadly, the first and second input switches, S1 and S2, are operating in the same state) the first lamp control switch RLA and the second lamp control switch RLB provide a power path and ground path, respectively, to the first lamp 106A in order to energize the first lamp 106A when the ballast 104 receives power from the AC power supply 102. When one input switch is conductive and the other is non-conductive (i.e., the first and second input switches, S1 and S2, are operating in different states), the first lamp control switch RLA and the second lamp control switch RLB provide a power path and ground path, respectively, to the second lamp 106B in order to energize the second lamp 106B when the ballast 104 receives power from the AC power supply 102. As such, in the lamp system 300, when the first and second input switches S1 and S2 are operated in the conductive state, the first lamp 106A is energized generating a first lighting output level. When the first and second input switches S1 and S2 are operated in different (e.g., opposite) states, the second lamp 106B is energized generating a second lighting output level.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A ballast comprising:

a switching network configured to selectively operate in a first state and in a second state;

a control circuit having an input terminal connected to the switching network and an output terminal configured to provide a first control signal when the switching network is operating in the first state and to provide a second control signal with the switching network is operating in the second state;

a first lamp control switch connected to the output terminal of the control circuit and to a ballast power supply, the first lamp control switch having a first output terminal configured to connect to a first terminal of a first lamp, the first lamp control switch having a second output terminal configured to connect to a first terminal of a second lamp, wherein the first lamp control switch is configured to operate between a first state in which the ballast power supply is in connection with the first output terminal, and a second state in which the ballast power supply is in connection with the second output terminal; and a second lamp control switch connected to the output terminal of the control circuit and to a ground potential, the second lamp control switch having a first output terminal configured to connect to a second terminal of the first lamp, the second lamp control switch having a second output terminal configured to connect to a second terminal of the second lamp, wherein the second lamp control switch is configured to operate between a first state in which the ground potential is connected to the first output terminal and a second state in which the ground potential is connected to the second output terminal;

wherein when the control circuit generates the first control signal, the first lamp control switch operates in the first state and the second lamp control switch operates in the first state so that the ballast provides power to the first lamp; and wherein when the control circuit generates the second control signal, the first lamp control switch operates in the second state and the second lamp control switch operates in the second state so that the ballast provides power to the second lamp.

2. The ballast of claim 1, further comprising a power input terminal adapted to connect to an alternating current (AC) power supply and receive AC power from the AC power supply, wherein the switching network comprises a single switch connected between the power input terminal and the control circuit.

3. The ballast of claim 2, wherein the switching network operates in the first state when the input switch inhibits conducting power from the power supply to the control circuit via the input switch, and wherein the switching network operates in the second state when the input switch conducts power from the power supply to the control circuit.

4. The ballast of claim 1, further comprising:

a first power input terminal adapted to connect to an alternating current (AC) power supply and receive AC power from the power supply;

a second power input terminal adapted to connect to the AC power supply and receive AC power from the AC power supply;

a neutral input terminal adapted to connect to the AC power supply; and a rectifier connected to convert AC power received from the AC power supply to direct current (DC) power, wherein the rectifier is connected between the first power, second power, and neutral input terminals and the first lamp control switch.

5. The ballast of claim 4, wherein the switching network comprises:

a first input switch connected between the first power input terminal and the rectifier, the first input switch having a conductive state wherein the first input switch conducts AC voltage from the AC power supply to the rectifier, and a non-conductive state wherein the first input switch inhibits power conduction from the AC power supply to the rectifier via the first input switch; and a second input switch connected between the second power input terminal and the rectifier, the second input switch having a conductive state wherein the second input switch conducts AC voltage from the AC power supply to the rectifier, and a non-conductive state wherein the second input switch inhibits power conduction from the AC power supply to the rectifier via the second input switch.

6. The ballast of claim 5, wherein the switching network operates in the first state when the first input switch is operating in the conductive state and the second input switch is operating in the conductive state, and wherein the switching network operates in the second state when one of the first input switch and the second input switch is operating in the conductive state and the other of the first input switch and the second input switch is operating in the non-conductive state.

7. The ballast of claim 4, further comprising:

a power factor correction circuit connected to the rectifier to produce a DC voltage output; and an inverter to convert the DC voltage output to AC voltage for providing to the lamps.

8. The ballast of claim 1, wherein the ballast is connected to the first lamp and to the second lamp, wherein the first lamp generates a first amount of lumens when energized by the ballast and the second lamp generates a second amount of lumens when energized by the ballast, the first amount of lumens and the second amount of lumens being different.

9. The ballast of claim 1, wherein the first lamp control switch and the second lamp control switch are connected together in parallel.

10. A ballast comprising:

a power input terminal adapted to connect to an alternating current (AC) power supply and receive AC power from the AC power supply;

a neutral input terminal adapted to connect to the AC power supply;

a control circuit to provide, as a function of receiving power from the AC power supply, one of a first control signal to power a first lamp and a second control signal to power a second lamp;

an input switch connected between the power input terminal and the control circuit, the input switch having a conductive state in which the input switch conducts power from the AC power supply to the control circuit, the input switch having a non-conductive state in which the input switch inhibits power conduction from the AC power supply to the control circuit via the input switch;

a first lamp control switch connected to the control circuit and to a ballast power supply, the first lamp control switch having a first output terminal configured to connect to a first terminal of the first lamp, the first lamp control switch having a second output terminal configured to connect to a first terminal of the second lamp, wherein the first lamp control switch is configured to operate between a first state in which the ballast power supply is in connection with the first output terminal, and a second state in which the ballast power supply is in connection with the second output terminal based on the control signal received from the control circuit; and a second lamp control switch connected to the output terminal of the control circuit and to a ground potential, the second lamp control switch having a first output terminal configured to connect to a second terminal of the first lamp, the second lamp control switch having a second output terminal configured to connect to a second terminal of the second lamp, wherein the second lamp control switch is configured to operate between a first state in which the ground potential is connected to the first output terminal and a second state in which the ground potential is connected to the second output terminal based on the control signal received from the control circuit.

11. The ballast of claim 10, wherein the first lamp control switch operates in the first state when the first lamp control switch receives the first control signal from the control circuit, and wherein the first lamp control switch operates in the second state when the first lamp control switch receives the second control signal from the control circuit.

12. The ballast of claim 10, wherein the second lamp control switch operates in the first state when the second lamp control switch receives the first control signal from the control circuit, and wherein the second lamp control switch operates in the second state when the second lamp control switch receives the second control signal from the control circuit.

13. The ballast of claim 10, wherein the control circuit provides the first control signal when the input switch is operating in the non-conductive state, and wherein the control circuit provides the second control signal when the input switch is operating in the conductive state.

14. The ballast of claim 10, wherein the ballast is connected to the first lamp and to the second lamp, wherein the first lamp generates a first amount of lumens when energized by the ballast and the second lamp generates a second amount of lumens when energized by the ballast, the first amount of lumens and the second amount of lumens being different.

15. The ballast of claim 10, further comprising:

a rectifier connected to the power input terminal and the neutral input terminal to convert AC power received from the AC power supply to direct current (DC) power;

a power factor correction circuit connected to the rectifier to produce a DC voltage output; and an inverter to convert the DC voltage output to AC voltage for providing to the lamps.

16. A ballast comprising:

a first power input terminal adapted to connect to an alternating current (AC) power supply and receive AC power from the AC power supply;

a second power input terminal adapted to connect to the AC power supply and receive AC power from the AC power supply;

a neutral input terminal adapted to connect to the AC power supply;

a rectifier to convert AC power received from the AC power supply to direct current (DC) power;

a power factor correction circuit connected to the rectifier to produce a DC voltage output;

an inverter to convert the DC voltage output to AC voltage for providing to the lamps;

a first input switch connected between the first power input terminal and the rectifier, the first input switch having a conductive state wherein the first input switch conducts AC voltage from the AC power supply to the rectifier, and a non-conductive state wherein the first input switch inhibits power conduction from the AC power supply to the rectifier via the first input switch;

a second input switch connected between the second power input terminal and the rectifier, the second input switch having a conductive state wherein the second input switch conducts AC voltage from the AC power supply to the rectifier, and a non-conductive state wherein the second input switch inhibits power conduction from the AC power supply to the rectifier via the second input switch;

a control circuit connected to the rectifier to generate a first control signal when the first input switch and the second input switch are operating in the same state, and to generate a second control signal when the first input switch and the second input switch are operating in different states;

a first lamp control switch connected to the control circuit and to a ballast power supply, the first lamp control switch having a first output terminal configured to connect to a first terminal of a first lamp, the first lamp control switch having a second output terminal configured to connect to a first terminal of a second lamp, wherein the first lamp control switch is configured to operate between a first state in which the ballast power supply is in connection with the first output terminal, and a second state in which the ballast power supply is in connection with the second output terminal; and a second lamp control switch connected to the output terminal of the control circuit and to a ground potential, the second lamp control switch having a first output terminal configured to connect to a second terminal of the first lamp, the second lamp control switch having a second output terminal configured to connect to a second terminal of the second lamp, wherein the second lamp control switch is configured to operate between a first state in which the ground potential is connected to the first output terminal and a second state in which the ground potential is connected to the second output terminal;

wherein when the control circuit generates the first control signal, the first lamp control switch operates in the first state and the second lamp control switch operates in the first state so that the ballast provides power to the first lamp; and wherein when the control circuit generates the second control signal, the first lamp control switch operates in the second state and the second lamp control switch operates in the second state so that the ballast provides power to the second lamp.

17. The ballast of claim 16, wherein the control circuit generates the first control signal when the first input switch and the second input switch are both operating in the conductive state.

18. The ballast of claim 16, wherein the control circuit generates the second control signal when one of the first input switch and the second input switch is operating in the conductive state and the other of the first input switch and the second input switch is operating in the non-conductive state.

19. The ballast of claim 16, wherein the ballast is connected to the first lamp and to the second lamp, wherein the first lamp generates a first amount of lumens when energized by the ballast and the second lamp generates a second amount of lumens when energized by the ballast, the first amount of lumens and the second amount of lumens being different.

20. The ballast of claim 16, wherein the first lamp control switch and the second lamp control switch are connected together in parallel.

* * * * *